US009572420B1

(12) United States Patent
Morris

(10) Patent No.: US 9,572,420 B1
(45) Date of Patent: Feb. 21, 2017

(54) PAINT BRUSH ATTACHABLE EDGING SHIELD

(71) Applicant: Shanty Morris, Charlotte, NC (US)

(72) Inventor: Shanty Morris, Charlotte, NC (US)

(73) Assignee: Shanty Morris, Charlotte, NC (US)

( * ) Notice: Subject to any disclaimer, the term of this patent is extended or adjusted under 35 U.S.C. 154(b) by 0 days.

(21) Appl. No.: 14/979,168

(22) Filed: Dec. 22, 2015

(51) Int. Cl.
*A46B 17/08* (2006.01)
*B44D 3/22* (2006.01)

(52) U.S. Cl.
CPC ..... *A46B 17/08* (2013.01); *B44D 3/225* (2013.01); *A46B 2200/202* (2013.01)

(58) Field of Classification Search
CPC ..... A46B 17/00; A46B 17/04; A46B 17/08; A46B 2200/202; A46B 2200/205; B44D 3/00; B44D 3/22; B44D 3/225
USPC ..... 15/166, 248.1
See application file for complete search history.

(56) References Cited

U.S. PATENT DOCUMENTS

| | | | | | |
|---|---|---|---|---|---|
| 2,175,587 | A | * | 10/1939 | Archer | B44D 3/225 15/166 |
| 2,584,504 | A | | 2/1952 | Seeber | |
| 2,791,790 | A | * | 5/1957 | Cooley | B44D 3/225 15/146 |
| 2,821,734 | A | | 2/1958 | Carrabine | |
| 2,900,657 | A | | 8/1959 | Gruden, Jr. | |
| 2,952,863 | A | | 9/1960 | Klecki | |
| 3,049,741 | A | | 8/1962 | Bessette et al. | |
| 3,210,791 | A | | 10/1965 | Rogholt | |
| 3,337,894 | A | | 8/1967 | Compton, Jr. | |
| 3,341,879 | A | * | 9/1967 | Kumpman | A46B 17/08 15/166 |
| 3,698,033 | A | | 10/1972 | French | |
| 4,004,318 | A | | 1/1977 | Balkus | |
| 4,705,418 | A | | 11/1987 | Wesenbeeck | |
| 6,163,920 | A | | 12/2000 | Meyer | |

FOREIGN PATENT DOCUMENTS

| | | | |
|---|---|---|---|
| EP | 661013 | * | 7/1995 |
| FR | 2291871 | * | 6/1976 |
| FR | 2713062 | * | 6/1995 |
| GB | 883328 | * | 11/1961 |
| GB | 2012577 | * | 8/1979 |
| GB | 2225528 | * | 6/1990 |

* cited by examiner

*Primary Examiner* — Mark Spisich

(57) ABSTRACT

A paint brush attachable edging shield for covering a side of a paint brush's bristles to provide edging control of a surface being painted without the use of painters tape includes a base shield which has a rigid shield body with a narrowed top edge, a rigid, elongated connector rod disposed between the base shield and a swivel dial, and a attachment member which allows the assembly to be attached to the handle of a paint brush. When in place on a paint brush, the base shield can be selectively rotated between a shielding position in which it is positioned against the bristles of the paint brush so as to block one side thereof, and a recessed position in which it is away from the bristles to allow them to be dipped into a paint reservoir.

7 Claims, 2 Drawing Sheets

PAINT BRUSH ATTACHABLE EDGING SHIELD

BACKGROUND OF THE INVENTION

Field of the Invention

This invention relates generally to paint brush attachments and, more particularly, to a socket extension bar for a paint brush attachable shield for providing straight edging and bordering.

Description of the Prior Art

The use of masking tape, such as painters tape, to cover surfaces while painting to allow for the controlled application of paint along edges or in corners is well known. Because the use of painters tape requires substantial preparation time and clean up time, there remains a need for an edging shield which could be attached to a paint brush in order to provide for controlled application of paint along edges or in corners. It would be helpful if such a paint brush attachable edging shield included an attachment tie to allow it to be removably attached to the handle of a paint brush. It would be additionally desirable for such a paint brush attachable edging shield to include a swivel dial operative to allow its base shield to be moved between a shielding position and a recessed position.

The Applicant's invention described herein provides for a paint brush attachable edging shield adapted to removably attach to a paint brush and allow a user to prevent a portion of the brush from contacting a target surface. The primary components in Applicant's paint brush attachable edging shield are a base shield, a connector rod, a swivel dial, and an zip tie. When in operation, the paint brush attachable edging shield enables more effective and efficient painting by obviating the need to apply and remove painters tape. As a result, many of the limitations imposed by prior art structures are removed.

SUMMARY OF THE INVENTION

A paint brush attachable edging shield for covering a side of a paint brush's bristles to provide edging control of a surface being painted without the use of painters tape. The paint brush attachable edging shield comprises a base shield which has a rigid shield body with a narrowed top edge, a rigid, elongated connector rod disposed between the base shield and a swivel dial, and an attachment member which allows the assembly to be attached to the handle of a paint brush. When in place on a paint brush, the base shield can be selectively rotated between a shielding position in which it is positioned against the bristles of the paint brush so as to block one side thereof, and a recessed position in which it is away from the bristles to allow them to be dipped into a paint reservoir.

It is an object of this invention to provide a paint brush attachable edging shield which provides for controlled application of paint along edges or in corners.

It is another object of this invention to provide a paint brush attachable edging shield which includes an attachment tie to allow it to be removably attached to the handle of a paint brush.

It is yet another object of this invention to provide a paint brush attachable edging shield which includes a swivel dial operative to allow its base shield to be moved between a shielding position and a recessed position.

These and other objects will be apparent to one of skill in the art.

DETAILED DESCRIPTION OF THE INVENTION

Figure 1:
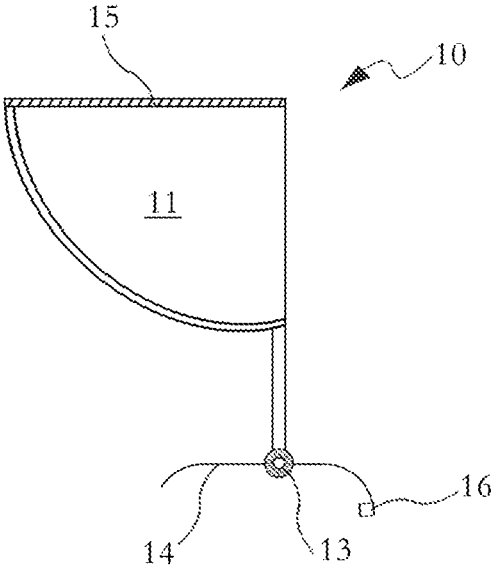
FIG. 1 is an elevational view of a paint brush attachable edging shield built in accordance with the present invention in its shielding position.
Figure 2:
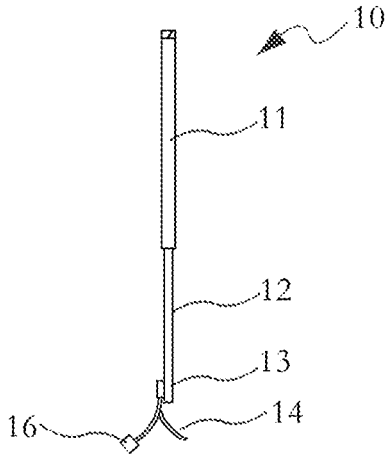
FIG. 2 is an elevational view of a paint brush attachable edging shield built in accordance with the present invention in its shielding position.
Figure 3:
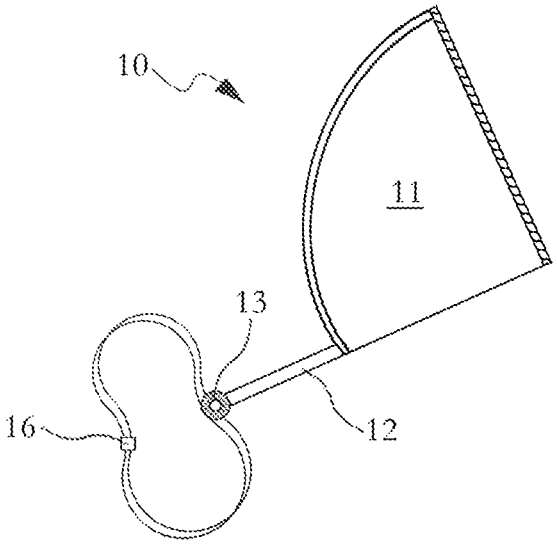
FIG. 3 is an elevational view of a paint brush attachable edging shield built in accordance with the present invention in its recessed position.

Referring now to the drawings and in particular FIGS. 1, 2, and 3, a paint brush attachable edging shield 10 is shown having a base shield 11, a connector rod 12, a swivel dial 13 and an attachment member 14. In the preferred embodiment, the base shield 11 is defined by a rigid shield body that is sized to cover the bristles of a conventional paint brush and includes a top edge 15 having a substantially thinner profile than the rest of the base shield 11 (as shown in FIG. 2). It is contemplated that the top edge 15 allows for greater precision at the edge of the base shield 11 which is to be positioned against the terminal end of the bristles of a target paint brush.

In the preferred embodiment, the connector rod 12 defines a rigid, elongated member that is connected at one end to the base shield and at the other end to the swivel dial 13, with the swivel dial 13 rotatably connected to the attachment member 14. In this regard, the connector rod 12 (and base shield 11) may be selectively rotated relative to the attachment member 14 between a shielding position and a recessed position.

In the preferred embodiment, the attachment member 14 defines a conventional zip tie having a pawl 16 at one end that is operative to receive an opposing free end and form a ratchet so that as the free end is pulled the attachment member 14 tightens and does not come undone.

Figure 4:
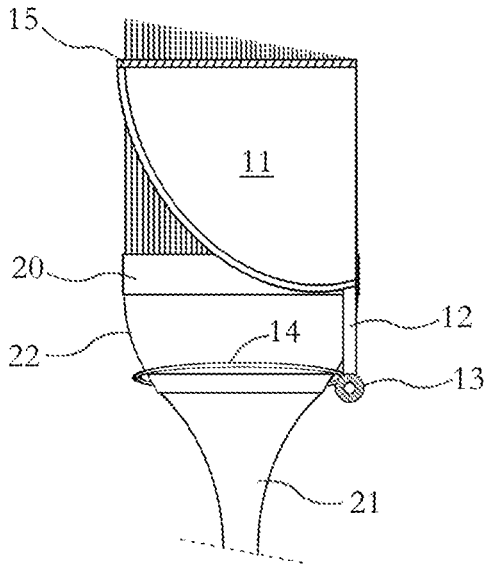
FIG. 4 is an elevational view of a paint brush attachable edging shield built in accordance with the present invention in its shielding position on a paint brush.

Referring now to FIG. 4, the paint brush attachable edging shield 10 is attached to the handle 21 of a conventional paint brush 20 by placing the attachment member 14 on the handle 21 below the belly 22 of the brush 20 (typically just below the ferrule). The attachment member 14 is then tightened around the handle 21, which in the preferred embodiment is accomplished by pulling the free end of the attachment member 14 through the pawl 16 as with conventional zip ties. Once tightened, the belly 22 of the brush 20 keeps the paint brush attachable edging shield 10 from sliding along the handle 21 towards the bristle end of the brush and a user's hand on the handle prevents the paint brush attachable edging shield 10 from sliding along the handle 21 award from the bristle end of the brush. The base shield 11 is thereby held against (or adjacent to) one side of the bristles of the paint brush 20 so that one side of the paint brush 20 is covered and cannot apply paint onto a surface.

Advantageously, when it is desired to dip the paint brush 20 into paint to restock its supply, the swivel dial 13 allows the base shield 11 to be rotated from a shielding position to the recessed position so that it does not become submerged in paint.

In some embodiments, an elongated, deformable member is employed in the alternated to the rigid connector rod 12 and swivel dial 13. In such embodiments, the base shield 11 can be selectively repositioned from and to the shielding position by simply reshaping the deformable member.

In an alternate embodiment, the attachment member defines an elastic band which can be stretched around the handle of a paint brush and then contract around it to be secure thereto. In yet another embodiment, the attachment member defines an adhesive flap which can be adhered to the target paint brush.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A paint brush attachable edging shield, comprising:

a base shield sized to cover the bristles on one side of a conventional paint brush;

an attachment member operative to removably attach to the handle of a conventional paint brush, wherein said attachment member defines a zip tie having a pawl at one end that is operative to receive an opposing free end; and a connector attached to the base shield and the attachment member such that when the attachment member is attached to the handle of a target paint brush, the base shield is positioned adjacent to the bristles on one side of the target paint brush.

2. The paint brush attachable edging shield of claim 1, wherein said connector defines a rigid, elongated rod.

3. The paint brush attachable edging shield of claim 1, wherein said base shield includes a top edge having a thinner profile than the rest of the base shield.

4. The paint brush attachable edging shield of claim 1, additionally comprising a swivel dial integral with the connector and operative to enable the connector to be rotated relative to the attachment member.

5. A paint brush attachable edging shield, comprising:

a base shield sized to cover the bristles on one side of a conventional paint brush;

an attachment member defining a zip tie having a pawl at one end that is operative to receive an opposing free end and operative to removably attach to the handle of a conventional paint brush;

a connector attached to the base shield and the attachment member such that when the attachment member is attached to the handle of a target paint brush, the base shield is positioned adjacent to the bristles on one side of the target paint brush; and a swivel dial integral with the connector and operative to enable the connector to be rotated relative to the attachment member.

6. The paint brush attachable edging shield of claim 5, wherein said connector defines a rigid, elongated rod.

7. The paint brush attachable edging shield of claim 5, wherein said base shield includes a top edge having a thinner profile than the rest of the base shield.

* * * * *